US008418986B2

(12) United States Patent
Looijen et al.

(10) Patent No.: US 8,418,986 B2
(45) Date of Patent: Apr. 16, 2013

(54) MOVABLE SUPPORTING CONSTRUCTION

(75) Inventors: Peter Nicolaas Looijen, The Hague (NL); Jacobus Gerardus Kolenbrander, Zoetermeer (NL)

(73) Assignee: Fugro Engineers B.V., Leidschendam (NL)

( * ) Notice: Subject to any disclaimer, the term of this patent is extended or adjusted under 35 U.S.C. 154(b) by 641 days.

(21) Appl. No.: 11/738,107

(22) Filed: Apr. 20, 2007

(65) Prior Publication Data

US 2007/0246620 A1 Oct. 25, 2007

Related U.S. Application Data

(63) Continuation-in-part of application No. PCT/NL2005/000694, filed on Sep. 26, 2005.

(30) Foreign Application Priority Data

Oct. 26, 2004 (NL) ..... 1027337

(51) Int. Cl.
*E05B 17/00* (2006.01)

(52) U.S. Cl.
USPC ..... 248/678; 405/169

(58) Field of Classification Search ..... 248/676, 248/181.2, 121, 346.01, 346.05; 405/169, 405/195.1, 224; 166/352, 338, 339, 341, 166/349; 403/348, 137
See application file for complete search history.

(56) References Cited

U.S. PATENT DOCUMENTS

| | | | | |
|---|---|---|---|---|
| 2,707,986 | A * | 5/1955 | Johnson | 248/583 |
| 2,988,144 | A * | 6/1961 | Conrad | 166/352 |
| 3,143,172 | A | 8/1964 | Wakefield | |
| 3,310,108 | A | 3/1967 | Yancy | |
| 3,358,753 | A * | 12/1967 | Haeber John A | 166/343 |

(Continued)

FOREIGN PATENT DOCUMENTS

GB 1503398 3/1978

OTHER PUBLICATIONS

"Report of the Offset Drilling Workshop", *Technical Note 25, Ocean Drilling Program, Texas A&M Univ.*, (Sep. 14, 1994),2, 7, 15, 16 and 18.

(Continued)

*Primary Examiner* — Korie H. Chan
(74) *Attorney, Agent, or Firm* — Jeffrey D. Myers; Samantha A. Updegraff; Peacock Myers P.C.

(57) ABSTRACT

A movable supporting construction for placing on a floor, comprising a lower part and an upper part cooperating with said lower part, wherein the lower part is designed to rest on the floor and to assume a position that is determined by the condition of the floor, and the upper part has a first and a second position, wherein in the first position, the upper part is suspended freely above the lower part and in the second position, the upper part rests on the lower part maintaining a predetermined invariant position, wherein in the second position, the lower part and the upper part are in line contact, thereby determining a contact line that forms at least a portion of a closed line.

25 Claims, 6 Drawing Sheets

U.S. PATENT DOCUMENTS

| | | | | | |
|---|---|---|---|---|---|
| 3,369,599 | A | | 2/1968 | Evans | |
| 3,489,210 | A | * | 1/1970 | Wakefield, Jr. | 166/352 |
| 3,614,869 | A | * | 10/1971 | Flory et al. | 405/224.2 |
| 3,625,171 | A | * | 12/1971 | Bailey | 114/314 |
| 3,643,446 | A | * | 2/1972 | Mott | 405/202 |
| 3,690,584 | A | * | 9/1972 | Wilkerson | 242/128 |
| 3,710,580 | A | * | 1/1973 | Mott | 405/202 |
| 3,735,597 | A | * | 5/1973 | Guy | 405/202 |
| 3,766,582 | A | * | 10/1973 | Lloyd et al. | 405/202 |
| 3,885,623 | A | * | 5/1975 | Watkins et al. | 166/335 |
| 4,005,881 | A | * | 2/1977 | Burton et al. | 285/111 |
| 4,298,219 | A | * | 11/1981 | Amelink | 285/24 |
| 4,335,979 | A | * | 6/1982 | Stafford | 405/202 |
| 4,591,296 | A | | 5/1986 | Henderson et al. | |
| 5,287,822 | A | * | 2/1994 | Anderson | 116/63 P |
| 6,409,428 | B1 | * | 6/2002 | Moog | 405/169 |

OTHER PUBLICATIONS

Ocean Drilling Program (ODP), "Hard Rock Base, ODP Legacy Operations: Coring Methods", ODP Website; www.opdlegacy.org/operations/hrb, Joint Oceanographic Institutions, Inc.,.

* cited by examiner

MOVABLE SUPPORTING CONSTRUCTION

CROSS-REFERENCE TO RELATED APPLICATIONS

This application is a continuation-in-part application of Patent Cooperation Treaty (PCT) Patent Application Serial No. PCT/NL2005/000694, entitled "MOVABLE SUPPORTING CONSTRUCTION", to Furgo Engineers B.V., filed on Sep. 26, 2005, and the specification and claims thereof are incorporated herein by reference.

This application claims priority to and the benefit of the filing of Netherlands Patent Application Serial No. NL 1027337, entitled "MOVABLE SUPPORTING CONSTRUCTION", filed on Oct. 26, 2004, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

The present invention relates to a movable supporting construction for placing on a floor. Such a supporting construction is used, for example, as a sea floor reaction mass when conducting a geotechnical survey from aboard a ship. This supporting construction is also referred to as Seabed Frame (SBF) and serves initially as reaction mass to the force needed to push a probe or sample tube into the ground. In addition, the supporting construction has several other functions such as drill-pipe guide, support for measuring, operating and control equipment for the geotechnical survey. The equipment of the supporting construction depends on the survey to be performed. Since the seabed is in general not flat or horizontal, it is important that the supporting construction be operable on a slope. If this is not possible, or only to a lesser extent, the applicability of the supporting construction becomes limited, which is undesirable.

Supporting constructions for operating on a slope exist. These constructions are usually embodied with a fixed hinge point (cardan-like) between two components, of which one has to adapt to the angle of the slope; they may also be provided with an extra device that is actively controlled by means of, for example, hydraulic cylinders. This is often realized after landing, with the aid of measurements. During positioning, also referred to as landing, these constructions are subject to internal frictions resulting from the parts being permanently coupled (cardan or hinge) so that they are either prevented from assuming the correct angle or they require active control. After landing, the components are often not fixed so as to avoid rotation in relation to one another, with the result that relatively minor external forces can cause the support construction to become unstable.

The inability to adequately compensate for the slope may have the following consequences:

- difficulties with guiding the drill pipe;
- difficulties with inserting the drill-pipe into the construction due to the drill-pipe and the top portion of the construction to be entered being oriented at different angles;

- problems with the other means that are pushed or introduced into the ground from or out of the supporting construction, which due to a small movement or due to a large angle difference, are no longer able to fulfill their function, or become damaged.

DESCRIPTION OF RELATED ART

An example of an existing construction is that of the Ocean Drilling Program (ODP), referred to as the "Hard Rock Base" (HRB). A description can be found on the ODP website. This is based on a cardan. Apart from the above-mentioned drawbacks of such a construction, the maximally allowable angle of incline of the ground is 20°.

GB 1503398 discloses a supporting construction for an underwater platform for a drilled well, wherein a guide frame lowers the drill-column onto a temporary base. The drill column rests on the temporary base by means of a ball-and-socket joint formed by spherical bowls fitting into each other, determining a supporting surface. With such a bearing, the size of the supporting surface changes with the angle of incline. As the angle of incline increases, the supporting surface becomes smaller. This limits the allowable angle of incline. In practice, the maximally allowable angle of incline with a construction as described in GB 1503398, will be smaller than 20°. Likewise, an increasing angle of incline makes such a support more asymmetrical. Thus as the angle of incline increases, the stability decreases.

BRIEF DESCRIPTION OF THE SEVERAL VIEWS OF THE DRAWINGS

The invention may be employed onshore but is, for example, especially suitable for landing on the seabed. Hereinafter the invention will be further elucidated by way of a description of a preferred embodiment and with reference to the appended drawings, in which.

DETAILED DESCRIPTION OF THE INVENTION

Figure 2:
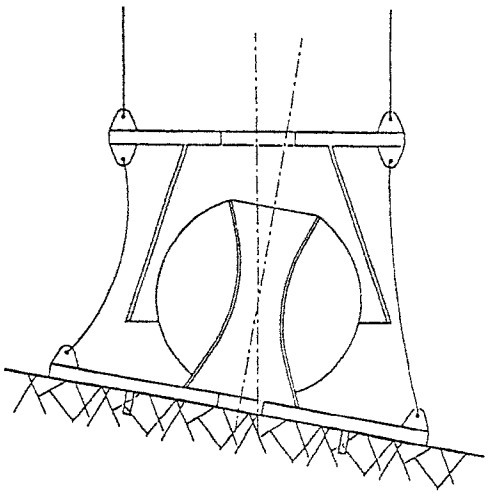
FIG. 1-FIG. 3 illustrate the landing of a supporting construction according to a first embodiment of the invention.

It is an object of the invention to provide a movable supporting construction able to reliably operate on a sloping surface that has a simple construction and avoids the drawbacks of the prior art solutions while having advantages that will be elucidated hereinafter.

This object is achieved with a supporting construction according to claim 1. The lower part is able to follow the surface of the floor, irrespective of its inclination. The upper part may then be placed on the lower part such that a particular desired orientation is maintained. This may, for example, be the horizontal orientation of a platform that is an element of the upper part. Owing to the upper part's own weight, the friction between the components of the lower part and the upper part, which during support in the second position are in contact with one another, provides a firm connection between the two parts. Once the construction is in position, there is no need to carry out further measurements or to keep the platform horizontal by means of controls and adjustments.

In the second position, the upper part and the lower part of the movable supporting construction according to the invention are in line contact and the contact line forms at least a portion of a closed line, such that the upper part is supported all round, i.e. in all directions, by the lower part. This ensures that the upper part is stably supported by the lower part, even at different angles of inclination. Moreover, the stability is hardly affected by the angle of inclination so that much larger angles of inclination are allowable.

When in a preferred embodiment the closed line is a circle, an all-round symmetrical and stable support is obtained on all sides.

In a favorable embodiment, the lower part possesses a first contact surface and the upper part possesses a second contact surface, which in the second position are cooperatingly in contact, and wherein at least a portion of either the first contact surface or the second contact surface is spherical. In a very favorable embodiment, at least a portion of the contact surface cooperating with the spherical contact surface is conical. This is particularly advantageous because in the second position, a cone and a sphere will form a circular contact line at any mutual angle so that the support is stabilized by friction, providing a stable position in all directions.

When a spherical and a conical contacting body cooperate with one another, there is the additional advantage that during the movement from the first position to the second position, i.e. when placing the upper part on the lower part, said contact surfaces have a centering effect on one another. If the upper part is not in precise central alignment with the lower part, the forces, which are not symmetrical at first contact, will guide the upper part to the centre of the lower contact surface.

To this end it is preferred for the at least partly conical contact surface to be provided with an opening whose diameter is at least one and a half times the diameter of the contact line.

A larger diameter of the contact line increases the supporting stability between the upper part and the lower part. The diameter of the contact line is therefore preferably at least one third part of the widest dimension of the upper part.

If desired, it is of course possible to provide extra connecting means such as clamps, traction ropes, traction rods and the like between the lower part and the upper part.

The section of the cone may have many different shapes. However, with a view to manufacturing costs, the section is advantageously triangular.

In order to prevent the supporting construction from sliding, it is an advantage for the lower part to be provided with anchoring means for anchoring in the ground.

Depending on the conditions of the ground, anchoring means to be provided may be plates or pins or combinations thereof, that are sunk into the ground.

In order to prevent the supporting construction itself sinking too deeply into the ground, it may be provided with a base plate upon which the construction rests on the ground.

An important advantage of the supporting construction according to the invention is that it is suitable for different inclines and different terrains.

If the upper part is embodied so as to be hoistable, it may be placed and removed, for example, so as to be placed somewhere else.

The supporting construction is very easy to place if the lower part and the upper part are connected with one another by a flexible connection. This flexible connection may be comprised of, for example, cables. The lower part is then, as it were, suspended from the upper part. During lowering, the parts are connected via the cables so as to be separate and movable in relation to each other. Since the lower part hangs clear, without being influenced by the upper part, it will be free to adapt to the angle of the slope. After the same has landed on the floor, the upper part after further lowering reaches the lower part in the same orientation in which it was while suspended, without being affected by the lower part. During lowering, the upper part maintains a horizontal orientation such that it creates a stable horizontal plane without being influenced by the slope of the floor.

In a special embodiment, the connection is formed by one continuous cable, running over discs, of which at least one is fastened to the lower part and at least one is fastened to the upper part. In this way the wire stays continuously under tension. In the case of separate wires, the tension in one of the wires may fall off due to the lower part already having found one supporting point during positioning. If the tension in one or two wires falls off, the upper part may, owing to the tension still present in the remaining wires, tilt slightly. Depending on the weight ratio between upper part and lower part, this tilting can be controlled and kept to a minimum. Tilting need pose no problem, as it is possible to arrange for sufficient space between the parts. As soon as the lower part is completely supported by the floor, the tension in all of the wires will fall off and the upper part will tilt back to its original orientation. However, this requires sufficient space and sufficiently long wires. In the case of a continuous wire, the upper part will not tilt and the construction can be made more compact. Instead of placing the upper part on the lower part, it is in this embodiment of the invention possible to pre-stress the hoisting cables, and thus the continuous wire. This provides a flexible connection, which may be advantageous in some circumstances since it avoids, for example, that, in drilling operations a transition from the drill-pipe in the water to the drill-pipe in the frame turns out to be too stiff. In this way the upper part is able to adjust according to the position of the drill-pipe, which is influenced for example, by the current in the water. If the discs are self-adjusting, the cable will run smoothly through the discs, irrespective of the conditions.

Although by no means limited thereto, the invention will be very suitable for guiding a drill-pipe, if during operation the supporting construction is provided with an opening to allow a pipe, such as a drill-pipe, to pass through.

Figure 1:
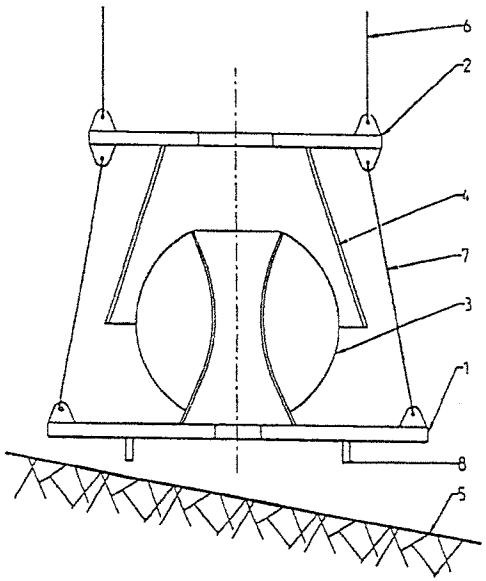

FIG. 1 shows a supporting construction in an embodiment of the invention comprising a lower part 1, provided with a spherical element 3, and an upper part 2, provided with a conical element 4. The lower part 1 and the upper part 2 are flexibly connected with each other by means of cables 7. In FIG. 1, the supporting construction is shown to be suspended from hoisting cables 6 above a sloping floor 5. The lower part is provided with a base plate for resting on the floor. The base plate is also provided with anchoring means 8.

In FIG. 2, the entire supporting construction has been lowered with respect to FIG. 1, and the lower part 1 has landed on the floor 5 and its base plate 19 is resting on the floor 5. The upper part 2 is still suspended above the lower part 1. The lower part 1 is anchored in the ground 5 through anchoring means 8 being sunk into the ground 5. The lower part 1 is tilted with respect to the upper part 2 and has adapted to the condition of the floor 5.

Figure 3:
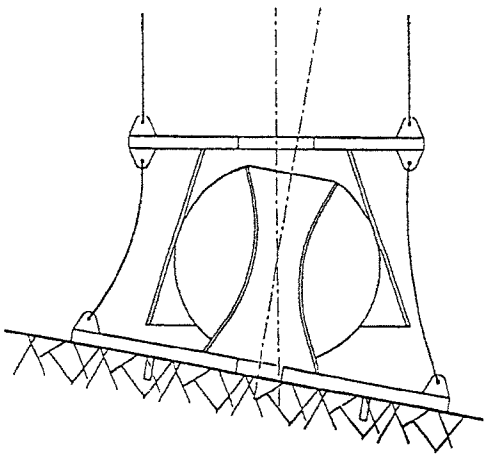

In FIG. 3, the upper part 2 has been lowered onto the lower part 1. The upper part 2 rests with its cone 4 on the sphere 3 of the lower part 1. The friction occurring between the cone 4 and the sphere 3 as a result of the weight of the upper part 2, ensures that the upper part 2 is stably positioned. The spherical element 3 of the lower part 1 and the conical element 4 of the upper part 2 together ensure that the orientation of the upper part 2 remains unchanged while landing on the lower part 1. This unchanged orientation is completely independent of the slope of the floor 5.

Figure 5:
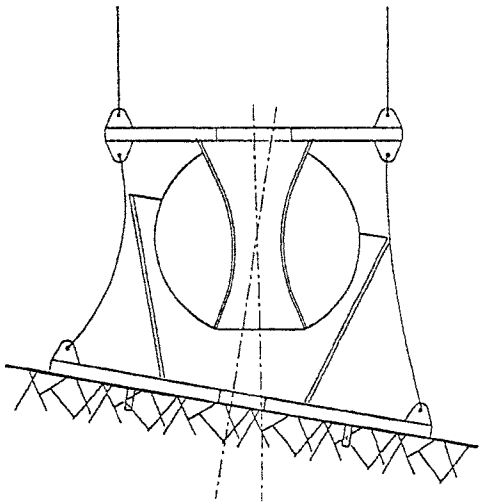
FIG. 4-FIG. 6 illustrate the landing of a supporting construction according to a second embodiment of the invention.
Figure 6:
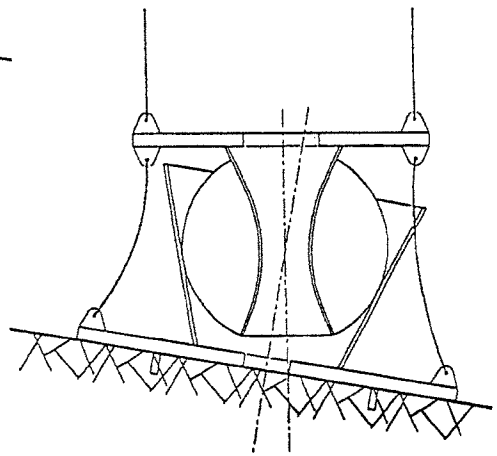
Figure 4:
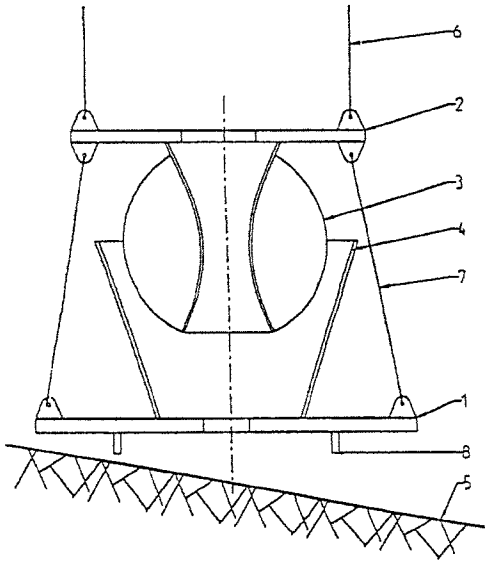

In FIG. 4-FIG. 6, a supporting construction is shown in a second embodiment of the invention, wherein the upper part 2 is provided with a spherical element 3 that cooperates with a conical element 4 of the lower part 1.

Figure 7:
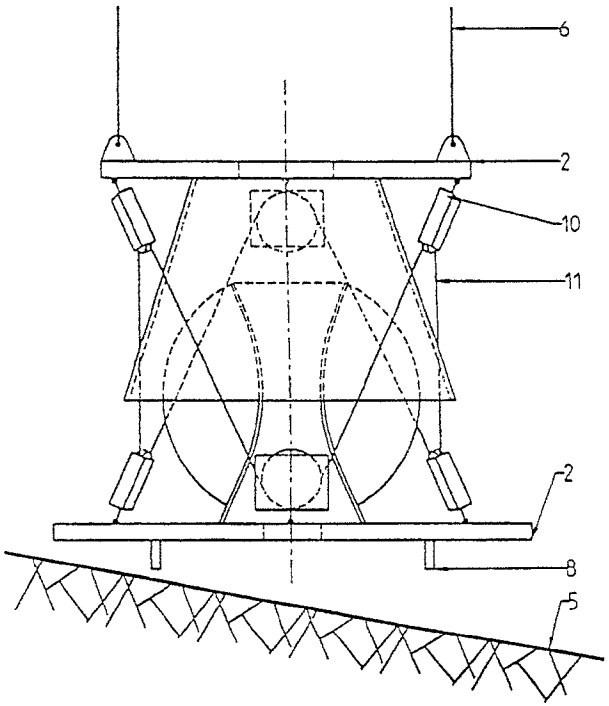
FIG. 7 illustrates a third embodiment of the invention.

In the embodiments shown in FIG. 1-FIG. 6, the cooperating elements of the lower part 1 and the upper part 2 are comprised of a spherical element 3 and a conical element 4. However, the invention is not limited to parts having these shapes. FIG. 7 shows the supporting construction in a third embodiment of the invention, wherein the flexible connection between the lower part 1 and the upper part 2 of the supporting construction is formed by a single continuous cable 11, running over self-adjusting discs 10.

Figure 9:
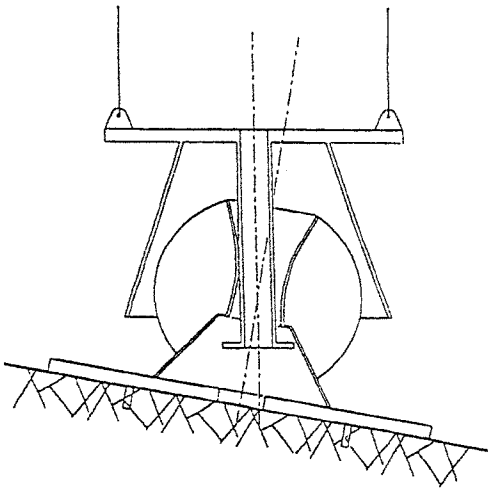
FIG. 8-FIG. 10 illustrate the landing of a supporting construction according to a fourth embodiment of the invention.
Figure 10:
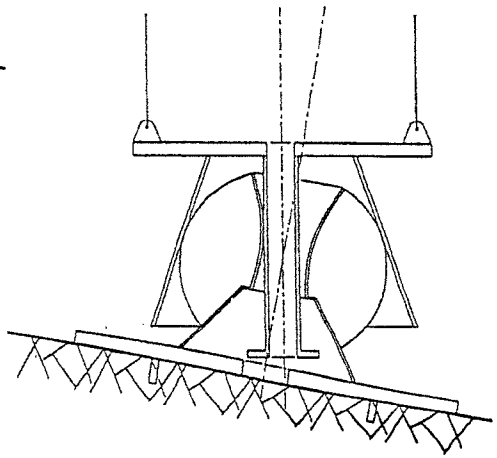
Figure 8:
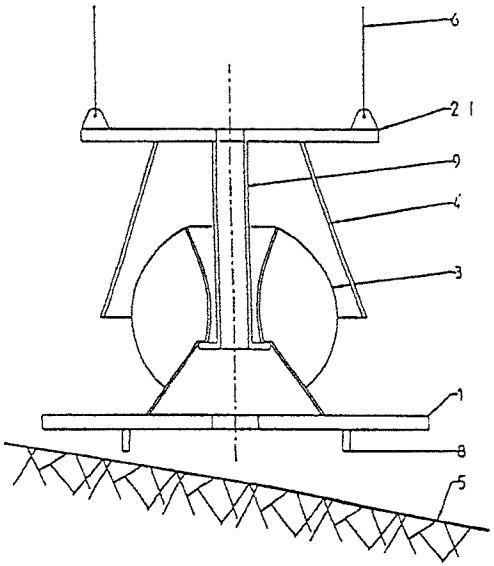

In FIG. 8-FIG. 10, a supporting construction is shown in a fourth embodiment of the invention, wherein the upper part 2 is provided with a pipe 9 having a flange at its bottom side upon which, in FIG. 8, rests the lower part 1 with a contact surface. After landing the lower part I on the floor 5 (FIG. 9), the upper part 2 is free to descend further and the flange of the pipe 9 comes free from the contact surface of the lower part 1. The upper part 2 is now able to descend further maintaining its orientation, until the conical element 4 of the upper part 2 settles on the spherical element 3 of the lower part 1.

Figure 12:
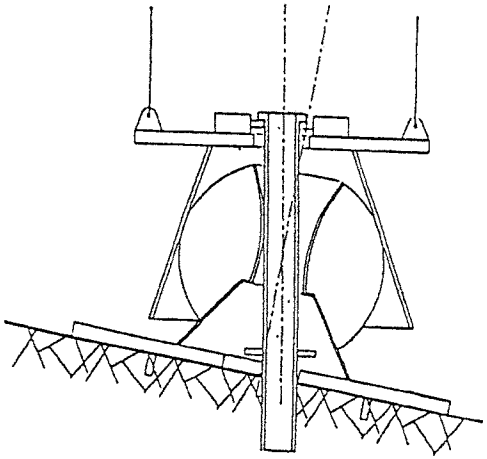
FIG. 11-FIG. 13 illustrate the landing of a supporting construction according to a fifth embodiment of the invention.
Figure 13:
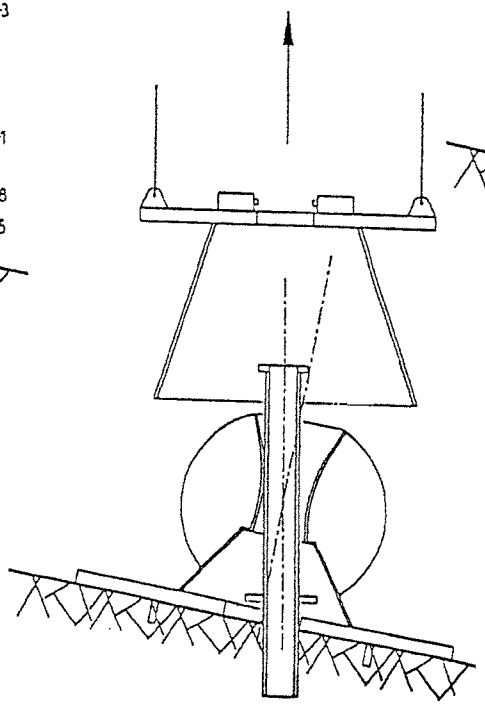
Figure 11:
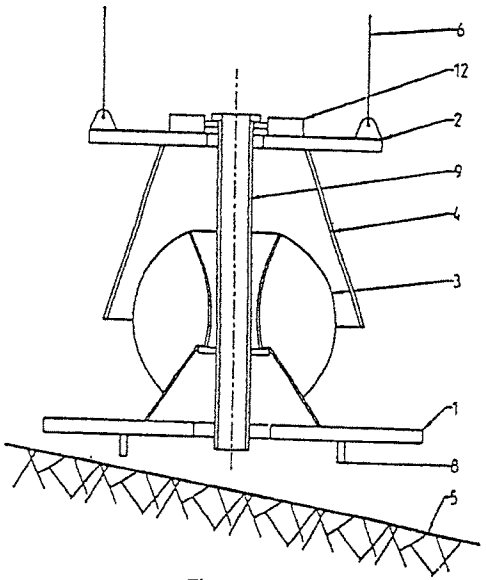

In FIG. 11-FIG. 13, a fifth embodiment of a supporting construction is shown, which is similar to the fourth embodiment shown in FIG. 8.-FIG. 10. In this case, however, pipe 9 is clamped to the upper part 2 by means of a clamping cylinder 12, allowing the upper part 2 to be uncoupled and removed from the lower part 1, while the lower part 1 remains on the floor 5. This makes it possible, for example, to use the upper part 2 elsewhere and, if desired, have it return at a later stage.

Figure 14:
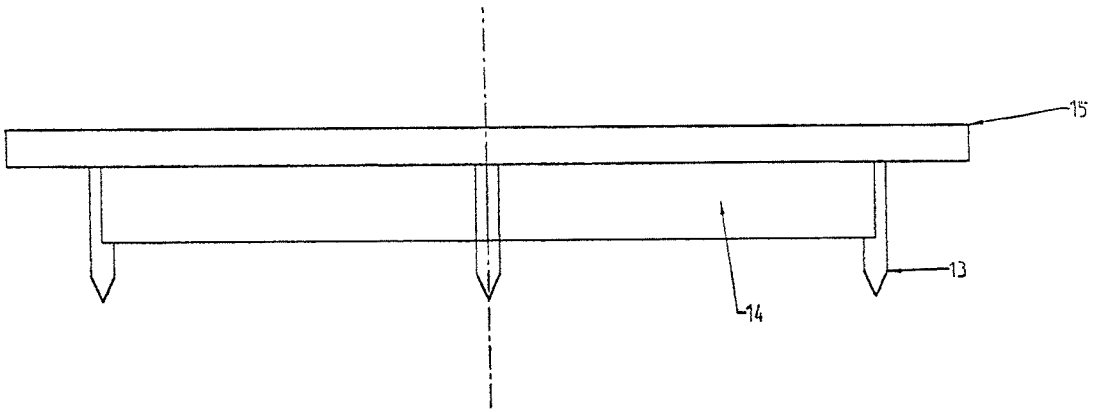
FIG. 14 illustrates two embodiments of anchoring means for anchoring the lower part in the ground.

FIG. 14 finally, illustrates two embodiments of means 8 for anchoring in the floor 5. Attached to the base plate 19 are pins 13 as well as a plate 14. Depending on the condition of the ground, it may be advantageous to use pins 13 or a plate 14 or a combination of these anchoring means 8. For the purpose of anchoring, the pins 13 as well as the plate 14, or plates 14, are sunk completely or partially into the ground 5.

What is claimed is:

1. A movable supporting construction for placing on a floor comprising:

a lower part and an upper part cooperating with said lower part, wherein the lower part is designed to rest on the floor and to assume a position that is determined by the condition of the floor, wherein a portion of the upper part comprises a conical element and a portion of the lower part comprises a spherical element, and wherein the upper part has a first and a second position, wherein in the first position, the upper part is suspended freely above the lower part against gravity but freely movable with respect to the lower part and in the second position, the conical element of the upper part rests on the spherical element of the lower part and is thus suspended against gravity by the lower part maintaining a predetermined invariant position by friction in the contact between the upper part and the lower part, wherein in the second position, the lower part and the upper part are in line contact, thereby determining a contact line that forms at least a portion of a closed line, wherein the upper part is brought from the first position to the second position by lowering; and wherein the upper part and the lower part are provided with connecting means for connecting the lower part and the upper part; and wherein the conical element is provided with an opening whose diameter is at least one and a half times the diameter of contact line.

2. A movable supporting construction in accordance with claim 1, wherein the closed line is a circle.

3. A movable supporting construction in accordance with claim 1, wherein the contact line lies on an at least a portion of the spherical element or a portion of the conical element.

4. A movable supporting construction in accordance with claim 1, wherein the diameter of the contact line is at least one third part of the widest dimension of the upper part.

5. A supporting construction in accordance with claim 1, wherein the lower part is provided with anchoring means for anchoring the lower part in the ground.

6. A supporting construction in accordance with claim 5, wherein the anchoring means comprise elements from the group consisting of at least one plate, at least one pin and combinations of these, wherein during use, these elements are at least partially sunk into the ground.

7. A supporting construction in accordance with claim 1 wherein the lower part is provided with a plate upon which the construction rests on the ground.

8. A supporting construction in accordance with claim 1, wherein the upper part is hoistable.

9. A supporting construction in accordance with claim 1, wherein the lower part and the upper part are connected with one another by a flexible connection.

10. A supporting construction in accordance with claim 9, wherein the flexible connection is comprised of cables.

11. A supporting construction in accordance with claim 9, wherein the flexible connection is formed by one continuous cable running over a first disc fastened to the lower part, .and a second disc fastened to the upper part.

12. A supporting construction in accordance with claim 11, wherein the first disc and the second disc are self-adjusting.

13. A supporting construction in accordance with claim 9, wherein the flexible connection comprises a pipe fastened to one or the other of the lower part and the upper part, wherein the pipe is provided with a flange, and the other of either the lower part or the upper part is provided with a contact surface that in a first position cooperates with the flange.

14. A supporting construction in accordance with claim 1, wherein the supporting construction is provided with an opening to allow a pipe, such as a drill-pipe, to pass through.

15. A supporting construction in accordance with claim 1, wherein the supporting construction is equipped to operate under water.

16. A movable supporting construction for placing on a floor, comprising:

a lower part and an upper part cooperating with the lower part, wherein the lower part is designed to rest on the floor and to assume a position that is determined by the condition of the floor, wherein a portion of said upper part comprises a spherical element and a portion of said lower part comprises a conical element, and wherein the upper part has a first and a second position, wherein in the first position, the upper part is suspended freely above the lower part against gravity but freely movable with respect to the lower part and in the second position, the spherical element of the upper part rests on the conical element of said lower part and is thus suspended against gravity by the lower part maintaining a predetermined invariant position by friction in the contact between the upper part and the lower part, wherein in the second position, the lower part and the upper part are in line contact, thereby determining a contact line that forms at least a portion of a closed line, and wherein the upper part is brought from the first position to the second position by lowering;

wherein the upper part and the lower part are provided with connecting means for connecting the lower part and the upper part; and wherein the conical element is provided with an opening whose diameter is at least one and a half times the diameter of contact line.

17. A movable supporting construction in accordance with claim 16, wherein the contact line lies on an at least a portion of the spherical element or a portion of the conical element.

18. A movable supporting construction in accordance with claim 16, wherein the diameter of the contact line is at least one third part of the widest dimension of the upper part.

19. A supporting construction in accordance with claim 16, wherein the lower part is provided with anchoring means for anchoring the lower part in the ground.

20. A supporting construction in accordance with claim 19, wherein the anchoring means comprise elements from the group consisting of at least one plate, at least one pin and combinations of these, wherein during use, these elements are at least partially sunk into the ground.

21. A supporting construction in accordance with claim 16 wherein the lower part is provided with a plate upon which the construction rests on the ground.

22. A supporting construction in accordance with claim 16, wherein the upper part is hoistable.

23. A supporting construction in accordance with claim 16, wherein the lower part and the upper part are connected with one another by a flexible connection.

24. A supporting construction in accordance with claim 23, wherein the flexible connection is comprised of cables.

25. A movable supporting construction in accordance with claim 16, wherein the closed line is a circle.

* * * * *